US005248410A

United States Patent [19]

Clausen et al.

[11] Patent Number: 5,248,410

[45] Date of Patent: Sep. 28, 1993

[54] DELAYED COKING OF USED LUBRICATING OIL

[75] Inventors: Glenn A. Clausen, Nederland; Christopher A. Paul, Port Neches, both of Tex.

[73] Assignee: Texaco Inc., White Plains, N.Y.

[21] Appl. No.: 800,813

[22] Filed: Nov. 29, 1991

[51] Int. Cl.[5] ..... C10G 9/14

[52] U.S. Cl. ..... 208/131; 208/50; 208/125; 208/177; 208/179

[58] Field of Search ..... 208/131

[56] References Cited

U.S. PATENT DOCUMENTS 5,143,597 9/1992 Sparks et al. ..... 208/131

*Primary Examiner*—Helane Myers

*Attorney, Agent, or Firm*—James L. Bailey; Kenneth R. Priem; Richard A. Morgan

[57] ABSTRACT

A feedstock comprising 10 to 15 wt % used motor oil is subjected to delayed coking to yield coke and distillate fractions.

11 Claims, No Drawings

DELAYED COKING OF USED LUBRICATING OIL

BACKGROUND OF THE INVENTION

1. Field Of The Invention

The invention relates to a petroleum refining process. More particularly, the invention relates to a delayed coking process for converting petroleum based feedstocks to coke, hydrocarbon liquids and gases. Most particularly the invention relates to converting used lubricating oil in a delayed coking process.

2. Description Of Other Related Methods In The Field

In a delayed coking process, a heavy liquid hydrocarbon fraction is converted to solid coke and lower boiling liquid and gaseous products. The fraction is typically a residual petroleum based oil or a mixture of residual oil with other heavy hydrocarbon fractions.

In a typical delayed coking process, the residual oil is heated by exchanging heat with liquid products from the process and is fed into a fractionating tower wherein light end products are removed from the residual oil. The residual oil is then pumped from the bottom of the fractionating tower through a tube furnace where it is heated under pressure to coking temperature and discharged into a coking drum.

In the coking reaction residual oil feedstock is thermally decomposed into solid coke, condensable liquid and gaseous hydrocarbons. The liquid and gaseous hydrocarbons are continuously removed from the coke drum and returned to the fractionating tower where they are separated into the desired hydrocarbon fractions.

When the coke drum becomes filled with coke, the flow of feedstock is terminated and solid coke is recovered from the coking drum. Coke quality determines its use. Two grades of high purity coke are used to manufacture electrodes for the steel and aluminum industry. Lower purity coke is used for fuel. The value of lower purity coke is calculated based on the sulfur and heavy metal impurities which are transferred from the feedstock to the coke.

Premium coke is a high purity grade of coke used for the manufacture of large graphite electrodes used in electric arc furnaces for the production of steel. The quality of premium coke is measured by its coefficient of thermal expansion (CTE) which may vary from as low as 0 to as high as $8\times10^{-7}$ centimeters per centimeter per degree centigrade. The best premium grade coke has a CTE of $5\times10^{-7}$ cm/cm/° C. or less.

Aluminum grade coke is another high purity grade of coke used for the manufacture of electrodes for the production of aluminum. Aluminum grade coke is of lesser purity than premium grade coke and contains amounts of sulfur and nitrogen. The CTE of aluminum grade coke is also substantially higher than the requirement of premium grade coke.

U.S. Pat. No. 4,666,585 to D. A. Figgins et al. discloses a delayed coking process. In the process, a petroleum sludge and a liquid hydrocarbon feedstock are subjected to delayed coking.

U.S. Pat. No. 3,917,564 to R. L. Meyers discloses a delayed coking process. Industrial waste or petroleum sludge are diluted with water as an aqueous quench medium. A low purity coke is formed.

U.S. Pat. No. 4,490,245 to T. C. Mead et al. teaches a process for reclaiming used lubricating oil. A used lubricating oil is vacuum distilled. The bottoms fraction is vacuum pyrolyzed with limestone to form an insoluble coked mass containing insoluble metal carbonates and free metal.

SUMMARY OF THE INVENTION

The invention is an improved delayed coking process. The process comprises passing a used petroleum derived lubricating oil to a reaction zone and coking at delayed coking reaction conditions. The reaction product comprises coke, hydrocarbon liquids and gas.

The process is useful for making effective economic use of used lubricating oil such as oil taken from crankcases of automobiles and trucks.

DETAILED DESCRIPTION OF THE INVENTION

Feedstocks for the delayed coking process include petroleum residual oil fractions. The principal charge stocks are high boiling virgin or cracked petroleum residua such as: virgin reduced crude, vacuum distillation bottoms, thermal tar, and other heavy residua and mixtures of these fractions. These residual oil fractions typically have an API gravity ranging from −5° to about 25° and an initial boiling point of about 550° F. to about 1000° F.

Petroleum based lubricating oils are derived from waxy petroleum distillate oil stocks. Such waxy petroleum distillate oil stocks have a viscosity of less than 50 SUS at 100° F. and have a boiling range of about 600° F. to 650° F. (315° C. to 343° C.) initial boiling point to about 1050° F. to 1100° F. (566° C. to 593° C.) end point. Such waxy petroleum distillate oil stocks may be derived from raw lube oil stocks the major portion of which boil above 650° F. (343° C.). These raw lube stocks are vacuum distilled with overhead and side draw distillate streams and a bottom stream referred to as residual oil stock. Considerable overlap in boiling ranges of distillate streams and the residual stream may exist, depending upon distillation efficiency. Some heavier distillates have almost the same distribution of molecular species as the residual stream. Both paraffinic and naphthenic crude oils are used as sources of lube oil stocks with paraffinic crudes giving the best yields of high viscosity index product, hence these are preferred for most lubricant applications.

Such distillate streams contain aromatic and polar compounds which are undesirable in lubricating oils. Such compounds are removed by means such as solvent extraction or hydrogenation before or after solvent dewaxing.

The wax content of a waxy distillate oil stock is defined by the amount of material to be removed to produce a dewaxed oil with a selected pour point temperature in the range of about +25° F. to −40° F. (−3.9° C. to −40° C.). Wax content of waxy distillate oil stock will vary in the range of 5 wt % to 35 wt %. Distillate oil stock is dewaxed typically by solvent dewaxing, however catalytic dewaxing processes have been found which will become industrially significant.

The dewaxed product is referred to as a lubricating oil base stock and is suitable for blending with other base stocks to achieve various desired properties. The blended base stock is then combined with additives such as soaps, E. P. agents, VI improvers and polymeric dispersants to produce an engine lubricating oil of SAE 5 to SAE 60. The engine lubricating oil, referred to in the art as motor oil, is poured into the crank case of internal combustion engines to lubricate moving parts.

After use, this oil is collected from truck and bus fleets and automobile service stations. Ideally this used oil is grade SAE 5 to SAE 60. Collected oil ordinarily contains base oil additive metals, other metal containing compounds and sludge formed in the engine.

In the improved process, used petroleum derived lubricating oil comprises the feedstock for the delayed coking process. Used lubricating oil may be the sole feedstock. In the alternative used lubricating oil is mixed with a petroleum residual oil or a mixture of residual oil fractions. Preferably the used lubricating oil comprises 5 wt % to 5 wt % of the feedstock with petroleum residual oil comprising the balance.

In the delayed coking process the feedstock is pumped at about 150 to 500 psig into a fired tube furnace where it is heated to about 850° F. to 975° F. and then discharged into a vertically oriented coking drum through an inlet in the bottom head. The pressure in the drum is maintained at 20 psig to 80 psig and the drum is insulated to reduce heat loss, so that the coking reaction temperature remains preferably between about 825° F. and 950° F. The hot feedstock thermally cracks over a period of several hours, producing hydrocarbon vapors which rise through the reaction mass and are removed from the top of the coke drum and passed to a coker fractionator. In the coker fractionator, the vapors are fractionally distilled to yield condensable liquids and gases.

The material which does not vaporize and remains in the vessel is a thermal tar. As the coking reaction continues, the coke drum fills with thermal tar which is converted over time at these coking reaction conditions to coke. At the end of the coking cycle, the coke is removed from the drum by cutting with a high impact water jet. The cut coke is washed to a coke pit and coke dewatering pad. The coke may be broken into lumps and may be calcined at a temperature of 2000° F. to 3000° F. prior to sampling and analysis for grading.

Premium grade coke, referred to in the art as needle grade coke, is used to make steel and for specialty alloy applications. This product has a coefficient of thermal expansion of 0.5 to $5\times10^{-7}$ cm/cm/° C., an ash content Of 0.001 to 0.02 wt %, volatiles of about 3 to 6 wt % and sulfur of about 0.1 to 1 wt %.

Aluminum grade coke, referred to in the art as anode grade coke, is used in the manufacturing of aluminum. This product has a density of about 0.75 to 0.90 gm/cc, an ash content of about 0.05 to 0.3 wt %, volatiles of about 7 to 11 wt % and sulfur of about 0.5 to 2.5 wt %.

Fuel grade coke typically has an ash content of about 0.1 to 2 wt %, volatiles of about 8 to 20 wt % and sulfur of about 1 to 7 wt %.

This invention is shown by way of example.

EXAMPLE

Three different vacuum resids were fractionated to an initial boiling point of 1000° F. A composite of used motor oil was made from Texas Gulf Coast collections. The properties of these four stocks is compiled in Table I.

A 2500 gram sample of each of these stocks and mixtures of vacuum resid and used motor oil were coked in glass flasks at 850° F. and atmospheric pressure for 12 to 33 hours until coking was completed. Gas samples were withdrawn during the beginning of the batch coking reaction. At the completion of the coking reaction vacuum was applied, the liquid produced in the coking reaction wa withdrawn and the coke recovered.

The liquids were fractionated in HYPERCAL® high efficiency glass columns. The fractions measured were dry gas, butanes, pentanes, 115° F. ($C_6$)−200° F. light naphtha, 200° F. to 400° F. heavy naphtha, 400° F. to 650° F. light gas oil and 650° F.+ heavy gas oil.

Examples 1, 4 and 7 are comparative, reporting the results of coking the three vacuum resids. Examples 2, 5 and 8 report the results of coking the vacuum resids with 10 wt % used motor oil. Examples 3, 6 and 9 report the results of coking the vacuum resids with 15 wt % used motor oil. Example 10 reports the results of coking used motor oil.

The results were as follows:

| | Example | | |
|---|---|---|---|
| | 1 | 2 | 3 |
| Feedstock | | | |
| Alaska North Slope Vacuum Resid | 100 wt % | 90 wt % | 85 wt % |
| Used Motor Oil | | 10 wt % | 15 wt % |
| Yield, wt % | | | |
| Dry Gas | 5.93 | 5.20 | 10.01 |
| Total Butanes | 3.12 | 2.86 | 0.98 |
| Total Pentanes | 1.05 | 0.71 | 0.57 |
| 115°-200° F. Light Naphtha | 2.10 | 1.89 | 2.25 |
| 200°-400° F. Heavy Naphtha | 10.58 | 10.41 | 9.76 |
| 400°-650° F. Light Gas Oil | 20.83 | 22.55 | 21.70 |
| 650° F.+ Heavy Gas Oil | 28.23 | 27.36 | 28.24 |
| Coke (1) | 28.18 | 29.02 | 26.48 |
| Coke Quality | | | |
| Carbon, wt % | 92.42 | 92.35 | 90.7 |
| Hydrogen, wt % | 4.08 | 4.15 | 3.61 |
| Moisture, wt % | 1.43 | 1.24 | 0.01 |
| Ash, wt % | 2.23 | 6.02 | 8.44 |
| Volatiles, wt % | 19.53 | 17.31 | 14.37 |
| Metals, wt % | 0.08 | 0.16 | 0.22 |
| Sulfur, wt % | 3.44 | 3.42 | 3.29 |
| Nitrogen, wt % | 1.57 | 1.49 | 1.51 |
| Liquid Product Quality | | | |
| Sulfur, wt % | | | |
| Composite Liquid | 1.26 | 1.06 | 1.07 |
| 115°-200° F. | 0.17 | 0.19 | 0.23 |
| 200°-400° F. | 0.60 | 0.53 | 0.54 |
| 400°-650° F. | 1.32 | 1.22 | 1.13 |
| 650° F.+ | 1.66 | 1.29 | 1.12 |
| Nitrogen, wppm. | | | |
| Composite Liquid | 1964 | 1620 | 1678 |
| 115°-200° F. | 57 | 118 | 193 |
| 200°-400° F. | 71 | 231 | 269 |
| 400°-650° F. | 993 | 1043 | 1061 |
| 650° F.+ | 3605 | 2712 | 2654 |
| 400°-650° F. Light Gas Oil | | | |
| Aromatics, vol % | 42.6 | 33.6 | 37.8 |
| Olefins, vol % | 25.5 | 28.9 | 29.3 |
| UV Absorbance | 3.21 | 2.96 | 3.08 |
| 650° F.+ Heavy Gas Oil | | | |
| Watson Aromatics, wt % | 61.1 | 53.7 | 51.0 |
| MCR, wt % | 0.29 | 0.18 | 0.17 |
| Metals, wppm | 124 | 62 | 66 |
| Chloride, wppm | 2 | 2 | 2 |

| | Example | | |
|---|---|---|---|
| | 4 | 5 | 6 |
| Feedstock | | | |
| Kern River Vacuum Resid | 100 wt % | 90 wt % | 85 wt % |
| Used Motor Oil | | 10 wt % | 15 wt % |
| Yield, wt % | | | |
| Dry Gas | 7.87 | 6.33 | 12.96 |
| Total Butanes | 1.24 | 1.45 | 0.65 |
| Total Pentanes | 0.08 | 0.79 | 0.82 |
| 115°-200° F. Light Naphtha | 1.31 | 10.25 | 2.57 |
| 200°-400° F. Heavy Naphtha | 8.67 | 11.60 | 12.42 |
| 400°-650° F. Light Gas Oil | 19.73 | 24.32 | 26.08 |
| 650° F.+ Heavy Gas Oil | 35.08 | 16.18 | 21.51 |

-continued

| | | | |
|---|---|---|---|
| Coke (1) | 25.25 | 29.09 | 22.99 |
| Coke Quality | | | |
| Carbon, wt % | 93.12 | 93.63 | 90.53 |
| Hydrogen, wt % | 3.61 | 3.68 | 4.08 |
| Moisture, wt % | 0.04 | 0.007 | 0.12 |
| Ash, wt % | 16.37 | — | 23.65 |
| Volatiles, wt % | 11.36 | 12.569 | 17.8 |
| Metals, wt % | 0.15 | 0.16 | 0.34 |
| Sulfur, wt % | 0.69 | 1.09 | 1.04 |
| Nitrogen, wt % | 3.04 | 2.61 | 2.77 |
| Liquid Product Quality | | | |
| Sulfur, wt % | | | |
| Composite Liquid | 1.01 | 0.75 | 0.69 |
| 115°-200° F. | 0.30 | 0.20 | 0.20 |
| 200°-400° F. | 0.99 | 0.82 | 0.73 |
| 400°-650° F. | 1.09 | 0.89 | 0.73 |
| 650° F.+ | 0.85 | 0.55 | 0.53 |
| Nitrogen, wppm. | | | |
| Composite Liquid | 6278 | 3778 | 3558 |
| 115°-200° F. | 59 | 287 | 350 |
| 200°-400° F. | 567 | 664 | 643 |
| 400°-650° F. | 3470 | 3283 | 2934 |
| 650° F.+ | 9778 | 6071 | 2795 |
| 400°-650° F. Light Gas Oil | | | |
| Aromatics, vol % | 45.6 | 40.7 | — |
| Olefins, vol % | 24.5 | 21.8 | — |
| UV Absorbance | 3.59 | 3.06 | 3.19 |
| 650° F.+ Heavy Gas Oil | | | |
| Watson Aromatics, wt % | 58.7 | 53.5 | 51.8 |
| MCR, wt % | — | 0.225 | 0.26 |
| Metals, wppm | 74 | 54 | 106 |
| Chloride, wppm | <1 | <1 | 1 |

| | Example | | |
|---|---|---|---|
| | 7 | 8 | 9 |
| Feedstock | | | |
| Arabian Heavy Vacuum Resid | 100 wt % | 90 wt % | 85 wt % |
| Used Motor Oil | | 10 wt % | 15 wt % |
| Yield, wt % | | | |
| Dry Gas | 8.18 | 7.42 | 7.38 |
| Total Butanes | 1.73 | 1.48 | 1.58 |
| Total Pentanes | 1.11 | 1.29 | 1.40 |
| 115°-200° F. Light Naphtha | 2.63 | 3.07 | 1.74 |
| 200°-400° F. Heavy Naphtha | 12.71 | 12.41 | 12.56 |
| 400°-650° F. Light Gas Oil | 25.28 | 25.14 | 27.09 |
| 650° F.+ Heavy Gas Oil | 17.31 | 15.73 | 15.97 |
| Coke (1) | 31.06 | 33.64 | 31.28 |
| Coke Quality | | | |
| Carbon, wt % | 87.6 | 89.12 | 88.56 |
| Hydrogen, wt % | 4.83 | 3.43 | 4.19 |
| Moisture, wt % | 0.09 | 0.007 | 0.18 |
| Ash, wt % | 13.79 | — | 16.95 |
| Volatiles, wt % | 24.13 | 11.04 | 11.56 |
| Metals, wt % | 0.10 | 0.17 | 0.28 |
| Sulfur, wt % | 7.86 | 9.89 | 7.95 |
| Nitrogen, wt % | 0.89 | 0.97 | 0.92 |
| Liquid Product Quality | | | |
| Sulfur, wt % | | | |
| Composite Liquid | 2.19 | 1.82 | 1.65 |
| 115°-200° F. | 0.14 | 0.20 | 0.20 |
| 200°-400° F. | 0.71 | 0.63 | 0.60 |
| 400°-650° F. | 2.51 | 2.24 | 2.04 |

-continued

| | | | |
|---|---|---|---|
| 650° F.+ | 4.05 | 2.23 | 2.21 |
| Nitrogen, wppm. | | | |
| Composite Liquid | 837 | 698 | 654 |
| 115°-200° F. | 47 | 113 | 139 |
| 200°-400° F. | 112 | 205 | 221 |
| 400°-650° F. | 477 | 566 | 616 |
| 650° F.+ | 2892 | 1346 | 1324 |
| 400°-650° F. Light Gas Oil | | | |
| Aromatics, vol % | 38.8 | 38.0 | 40.2 |
| Olefins, vol % | 15.7 | 22.8 | 21.9 |
| UV Absorbance | 3.50 | 2.93 | 3.12 |
| 650° F.+ Heavy Gas Oil | | | |
| Watson Aromatics, wt % | 62.1 | 51.2 | 47.2 |
| MCR, wt % | 0.67 | 0.11 | 0.11 |
| Metals, wppm | 258 | 472 | 159 |
| Chloride, wppm | 8 | 9 | 6 |

| | Example 10 |
|---|---|
| Feedstock | 100 wt % |
| Used Motor Oil | |
| Yield, wt % | |
| Dry Gas | 4.06 |
| Total Butanes | 2.21 |
| Total Pentanes | 1.38 |
| 115°-200° F. Light Naphtha | 6.99 |
| 200°-400° F. Heavy Naphtha | 16.38 |
| 400°-650° F. Light Gas Oil | 40.19 |
| 650° F.+ Heavy Gas Oil | 23.24 |
| Coke (1) | 5.54 |
| Coke Quality | |
| Carbon, wt % | 81.31 |
| Hydrogen, wt % | 3.47 |
| Moisture, wt % | 2.7 |
| Ash, wt % | 14.23 |
| Volatiles, wt % | 19.43 |
| Metals, wt % | 3.81 |
| Sulfur, wt % | 2.53 |
| Nitrogen, wt % | 1.00 |
| Liquid Product Quality | |
| Sulfur, wt % | |
| Composite Liquid | 0.19 |
| 115°-200° F. | 0.11 |
| 200°-400° F. | 0.13 |
| 400°-650° F. | 0.19 |
| 650° F.+ | 0.27 |
| Nitrogen, wppm. | |
| Composite Liquid | 637 |
| 115°-200° F. | 308 |
| 200°-400° F. | 556 |
| 400°-650° F. | 702 |
| 650° F.+ | 668 |
| 400°-650° F. Light Gas Oil | |
| Aromatics, vol % | 24.4 |
| Olefins, vol % | 38.5 |
| UV Absorbance | 1.71 |
| 650° F.+ Heavy Gas Oil | |
| Watson Aromatics, wt % | 30.5 |
| MCR, wt % | 0.00 |
| Metals, wppm | 62 |
| Chloride, wppm | 1 |

(1) Adjusted to 12 wt % Volatiles

TABLE 1

| Feedstock | Alaska North Slope Vacuum Resid | Kern River Vacuum Resid | Arabian Heavy Vacuum Resid | Used Motor Oil |
|---|---|---|---|---|
| Test Results | | | | |
| API Gravity | −6.7° | −5.7° | −6.2° | +25.4° |
| 1000° F.+, vol % | 92.3 | 81.9 | 89.1 | 14.3 |
| Sulfur, wt % | 2.418 | 1.328 | 5.642 | 0.382 |
| Total Nitrogen, wppm | 5629 | 10455 | 4189 | 1362 |
| Carbon, wt % | 85.90 | 85.68 | 83.69 | 82.49 |
| Hydrogen, wt % | 11.13 | 11.22 | 10.76 | 13.79 |
| MCR, wt % | 18.317 | 15.908 | 21.201 | 1.823 |
| Kinematic Viscosity, cSt | | | | |
| @ 212° F. | 3402 | 2799 | 3625 | 12 |
| @ 250° F. | 855 | 657 | 951 | — |

TABLE 1-continued

| Feedstock | Alaska North Slope Vacuum Resid | Kern River Vacuum Resid | Arabian Heavy Vacuum Resid | Used Motor Oil |
|---|---|---|---|---|
| @ 300° F. | 210 | 150 | 239 | — |
| Pour Point, °F. | 120 | 120 | 120 | −44 |
| Ash, wt % | 4.16 | 0.04 | 0.86 | 0.03 |
| Metals, weight ppm | 680 | 872 | 710 | 3565 |
| Chloride, weight ppm | 7.4 | 4.9 | 31 | 285 |

MCR - Micro Carbon Residue (Conradson Carbon Residue)

TABLE OF TEST METHODS

| | |
|---|---|
| Coke Quality | |
| Sulfur | ASTM D-1552 |
| Carbon | ASTM D-3178 |
| Hydrogen | ASTM D-3178 |
| Nitrogen | ASTM D-3178 |
| Moisture | ASTM D-3173 |
| Ash | ASTM D-3174 |
| Volatiles | ASTM D-3175 |
| Metals | ASTM D-4326 |
| Feedstock | |
| 1000° F.+ | ASTM D-1160 |
| Sulfur | ASTM D-1552 |
| Total Nitrogen | ASTM D-4629 |
| Carbon | ASTM D-3178 |
| Hydrogen | ASTM D-3178 |
| Microcarbon Residue (MCR) | ASTM D-4530 |
| Pour Point | ASTM D-97 |
| Ash | ASTM D-3174 |
| Metals | ASTM D-4326, D-4951 |
| Chloride | ASTM D-4326 |
| Liquid Product Quality | |
| Sulfur | ASTM D-1552 |
| Nitrogen | ASTM D-4629 |
| Aromatics | ASTM D-1319 |
| Olefins | ASTM D-1319 |
| UV Absorbance | ASTM D-2008 |
| Watson Aromatics | Titration |
| Micro Carbon Residue (MCR) | ASTM D-4530 |
| Metals | ASTM D-4326 |
| Chloride | ASTM D-4326 |

Examples 1, 4 and 7 represent coking of the base vacuum resids and are representations of the current state of the art (no used motor oil injection).

Examples 2, 5 and 8 represent coking of the base vacuum resids with 10 wt % used motor oil. As can be seen in the examples, considerable deceases in dry gas yield are shown as compared to Examples 1, 4 and 7. Coke yield increases, possibly due to the additional metals present as ash in the used motor oil being injected. Considerable reduction in 650° F.+ heavy gas oil yield is observed upon injection of used motor oil at all concentrations tested which is unexpected. Most likely, paraffinic material in the used motor oil is cracking into the light gas oil boiling range.

Examples 3, 6 and 9 represent coking of the base vacuum resids with 15 wt % used motor oil. The dry gas yield has now increased over the base or the 10 wt % injection cases. This indicates that a minimum dry gas production occurs at or around 10 wt % used motor oil injection with the feed.

Accompanying this increase in dry gas yield when 15 wt % used motor oil is injected with the feed is the observed decrease in coke yield. This is also unexpected, but evidently a portion of the material that was producing coke when 0 or 10 wt % used motor oil was injected into the feed now forms 650° F.+ heavy gas oil instead of coke. The injection of 15 wt % used motor oil is preventing the formation of coke.

Results of product quality testing indicate that used motor oil injection can be used to lower liquid product sulfur, nitrogen, light gas oil and heavy gas oil aromatics, heavy gas oil carbon residue (MCR), and heavy gas oil metals content (see lines 25 to 45 in Examples 1–10).

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A delayed coking process comprising: passing a used petroleum based motor lubricating oil to a reaction zone and coking at a temperature of about 825° F. (440° C.) to 950° F. (510° C.) and pressure of about 20 psig (2.36 atm) to 80 psig (6.44 atm), thereby producing coke, liquid and gas.

2. The process of claim 1 wherein delayed coking conditions include a temperature of about 850° F.

3. The process of claim 1 wherein said coke is anode grade coke.

4. A delayed coking process comprising: passing a delayed coking feedstock comprising about 5 wt % to 15 wt % of a used petroleum based motor lubricating oil to a reaction zone and coking at a temperature of about 825° F. (440° C.) to 950° F. (510° C.) and a pressure of 20 psig (2.36 atm) to 80 psig (6.44 atm), thereby producing coke, liquid and gas.

5. The process of claim 4 wherein said feedstock comprises about 10 wt % of the used petroleum lubricating oil.

6. The process of claim 4 wherein delayed coking conditions include a temperature of about 850° F.

7. The process of claim 4 wherein said coke is anode grade coke.

8. A delayed coker process comprising: heating a coker feedstock comprising used petroleum based motor lubricating oil in a furnace to a coking reaction temperature; passing the feedstock to a reaction zone and coking at a temperature of about 825° F. (440° C.) to 950° F. (510° C.) and a pressure of about 20 psig (2.36 atm) to 80 psig (6.44 atm), thereby producing coke, liquid and gas.

9. The process if claim 8 wherein the feedstock comprises about 5% to about 15% of the used oil and the balance petroleum residual oil.

10. The process of claim 8 wherein the delayed coking reaction conditions include a temperature of about 850° F.

11. The process of claim 8 wherein said coke is anode grade coke.

* * * * *

UNITED STATES PATENT AND TRADEMARK OFFICE

CERTIFICATE OF CORRECTION

PATENT NO. : 5,248,410

DATED : September 28, 1993

INVENTOR(S) : Glenn Allen Clausen
Christopher Alan Paul

It is certified that error appears in the above-indentified patent and that said Letters Patent is hereby corrected as shown below:

Column 8, claim 4, line 39, after "of" insert --about--

Signed and Sealed this

Twelfth Day of April, 1994

*Attest:*

*Attesting Officer*

BRUCE LEHMAN

*Commissioner of Patents and Trademarks*